US005170712A

United States Patent [19]

Stehouwer

[11] Patent Number: 5,170,712

[45] Date of Patent: Dec. 15, 1992

[54] MAGNETIC CLEANER FOR PRINTING PRESS MEDIUM

[75] Inventor: William J. Stehouwer, Lansing, Mich.

[73] Assignee: The John Henry Company, Lansing, Mich.

[21] Appl. No.: 844,846

[22] Filed: Mar. 3, 1992

[51] Int. Cl.[5] ..... B41F 35/00

[52] U.S. Cl. ..... 101/425; 101/417

[58] Field of Search ..... 101/425, 416.1, 417, 101/419, 483; 400/719; 15/1.51, 77, 105

[56] References Cited

U.S. PATENT DOCUMENTS

| | | | |
|---|---|---|---|
| 1,700,865 | 2/1929 | Trier | 101/417 |
| 1,744,151 | 1/1930 | Ball | 101/425 |
| 3,659,526 | 4/1972 | Staller | 101/425 |
| 5,020,433 | 6/1991 | Seschue et al. | 101/425 |

FOREIGN PATENT DOCUMENTS

| | | | |
|---|---|---|---|
| 0105354 | 6/1982 | Japan | 101/425 |

OTHER PUBLICATIONS

"Magnetic Brush Cleaning System", Xerox Disclosure Journal, vol. 6, No. 5, Sep. 10, 1981 pp. 257-258.

"Cleaning Nip Stability/Magnetic Brush", Xerox Disclosure Journal, vol. 5, No. 1, Jan./Feb. 1980, pp. 105-106.

"Self-Cleaning Electromagnetic Carrier Attracting Devices for Electrostatic Copying Machines", Xerox Disclosure Journal, vol. 4, No. 2 Mar. 4, 1979 pp. 167-168.

*Primary Examiner*—Eugene H. Eickholt

*Attorney, Agent, or Firm*—Price, Heneveld, Cooper, DeWitt & Litton

[57] ABSTRACT

A device is provided for catching and holding loose metal articles accidentally dropped into a printing machine, thus preventing the articles from being fed into the press and damaging printing cylinders therein. The device is a magnet in the shape of elongate bar adjustably positioned over the input opening of the printing press and positioned downstream of the automatic feeding apparatus for the press. The magnetic bar is spaced a distance above the path of sheet stock being fed into the printing press so that metal articles accidentally dropped onto or carried by the sheet are magnetically picked up and held until removed by maintenance personnel or a press operator.

17 Claims, 1 Drawing Sheet

MAGNETIC CLEANER FOR PRINTING PRESS MEDIUM

BACKGROUND OF THE INVENTION

This invention relates to a safety device attachable to a printing press or the like, and in particular to a device for catching loose metal articles that can be accidentally dropped or carried into a printing press and damage same.

Modern high speed offset printing presses include multiple printing cylinders adapted to transfer ink images onto sheet stock being fed through the press. The printing presses further include feeding apparatus for automatically feeding the stock into the printing presses. Necessarily, the feeding apparatus includes various adjustable or movable parts so that the feeding apparatus can accept a variety of different sheet sizes and thicknesses, and automatically feed same reliably into the press. These parts include various small metal parts such as nuts, bolts, washers, roller bearings, etc. which over an extended period of time may become loose and accidentally fall into or be carried into the printing press. Also, metal tools such as Allen wrenches and screwdrivers or the like, used for press adjustment and maintenance, may be left in a position where they may fall or be carried into the printing press. While these incidents do not occur often, they are very serious and costly when they do occur. For example, if an undesirable article is carried into contact with one of the printing cylinders, the article can dent or otherwise damage the cylinder, potentially costing $50,000 to $60,000 to repair. Further, since the cylinders are expensive, replacement cylinders are often not kept in-house and the printing press may be down for one or more weeks while waiting for a replacement cylinder. At minimum, the repair may consume a shift or more, even if a replacement cylinder is available. Still further, once damaged, the printing cylinder does not have the quality of a new cylinder.

Therefore, it is desirable to install a device attachable to the press to catch these small articles before they enter the printing press and cause damage.

SUMMARY OF THE INVENTION

The present invention relates to a safety device for a printing machine and includes a magnet for magnetically attracting loose metal articles which can be carried into the press and which can damage a working member in the press. The magnet is preferably located at the input of the press adjacent the path of stock being fed into the press. In the preferred embodiment, the magnet is an elongate permanent magnet positioned above the path of the stock so that it can attract and hold the loose metal articles as the articles are carried past the magnet on stock being fed into the press.

The present invention offers several advantages over known art. The magnet of the preferred embodiment is easy to use and simple in operation, and further is relatively inexpensive to purchase and install. Further, the magnetic bar is surprisingly effective, particularly with loose metal pieces/articles such as nuts, bolts and etc. which can be carried on the stock being fed into a printing press.

These and other features, objects and advantages of the present invention will become apparent upon reading the following description thereof together with reference to the accompanying drawings.

DETAILED DESCRIPTION OF THE PREFERRED EMBODIMENT

Figure 1:
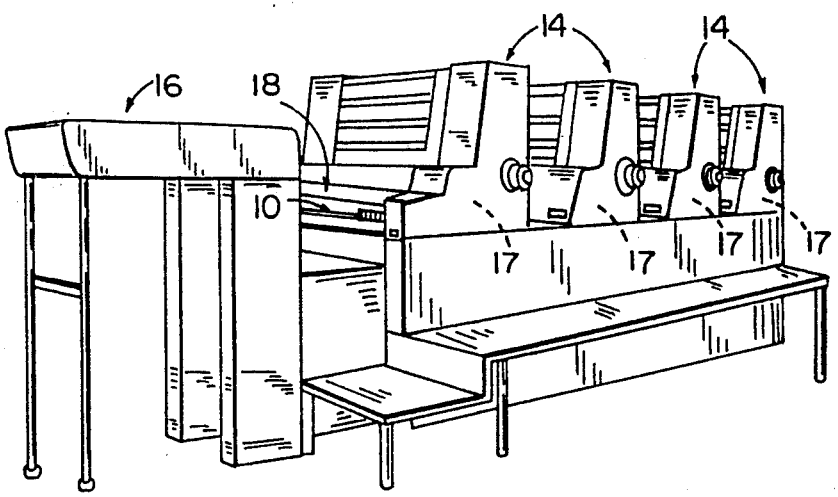
FIG. 1 is a perspective view of a printing press including a safety device embodying the present invention.
Figure 2:
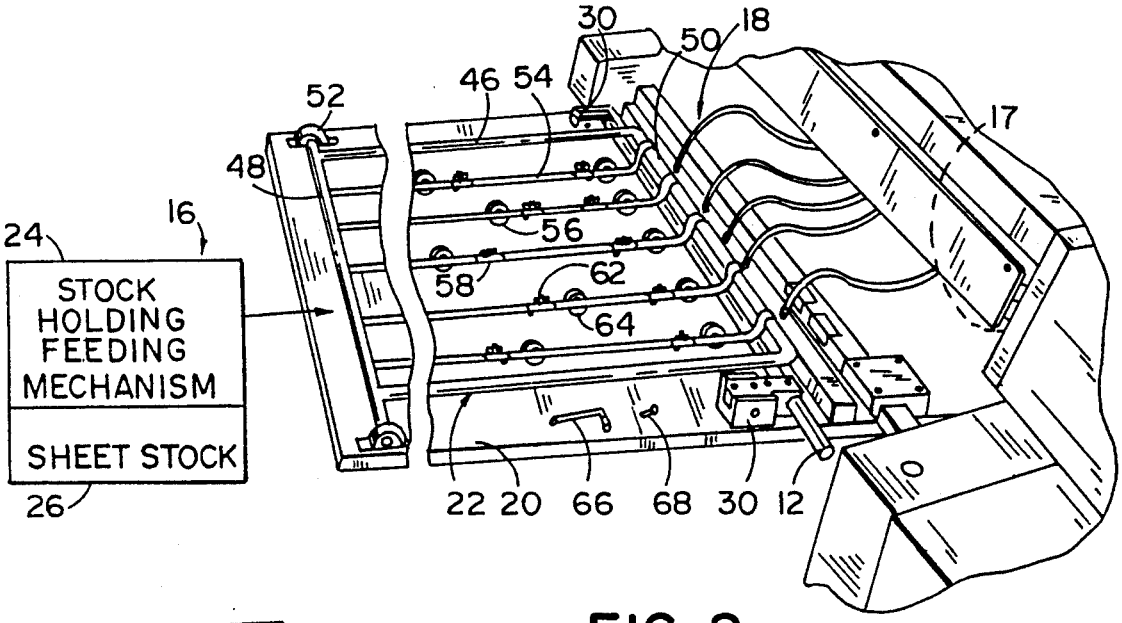
FIG. 2 is an enlarged top perspective view of the stock input opening to the printing press shown in FIG. 1, with the safety device located therein.
Figure 3:
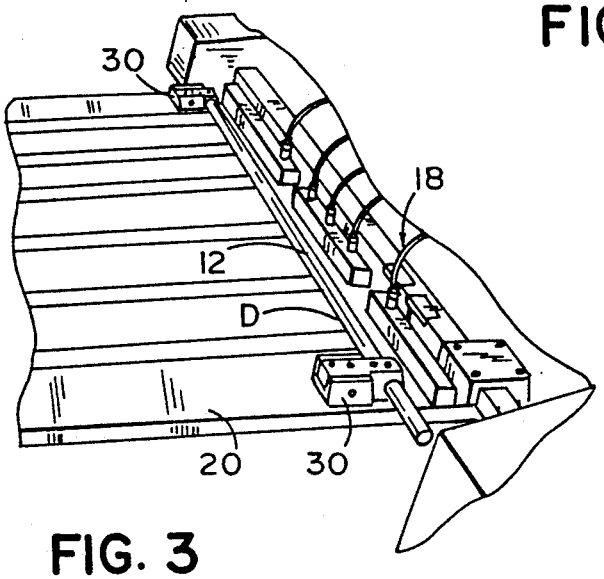
FIG. 3 is a perspective view similar to FIG. 2 but with the upper guide lifted away.
Figure 4:
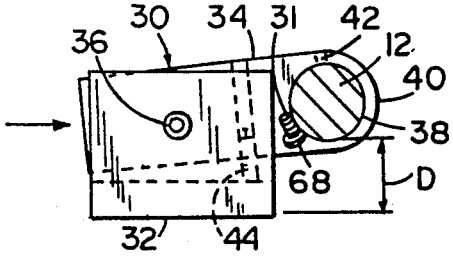
FIG. 4 is a side view of the bracket for holding the safety device.

The present invention is embodied in a safety device 10 as illustrated in FIGS. 1–4. Safety device 10 includes an elongate permanent magnet or magnetic bar 12 placed adjacent the throat or input opening 18 to press 14 and downstream of the feeding apparatus 16. Safety device 10 is particularly adapted for use on high speed offset: printing presses where small steel nuts, bolts, and like articles can be particularly damaging to a printing cylinder or working member 17 of the printing press. However, the safety device can be used on any printing press where it is desirable to attract and hold steel articles being carried by the feed stock into a press where working members or dies can be damaged by the small articles.

In the illustrated example, printing press 14 is a Miller press model number TP-38A. The Miller press has multiple stations, with a set of working members 17 comprising three permanent cast iron chrome plated printing cylinders located at each station. The cylinders are soft enough such that they are dented if a steel part such as a nut or bolt is fed into and past the cylinders, thus damaging the cylinder surface in a way that both reduces printing quality and also is difficult to repair. However, though only a particular Miller press is shown, the magnetic safety bar can also be used on a web fed printing press wherein a roll of stock is continuously unrolled and fed into the printing press. Further, bar 12 can be used on other types of presses as well.

Feeding apparatus 16 includes a lower chute support 20 inclined toward press 14. An upper cage or guide 22 is positioned above and parallel to chute support 20. A stock holding/feeding mechanism 24 is positioned to feed stock 26 into the space between chute support 20 and upper cage 22. Stock 26 is placed in stock holding-/feeding mechanism 24 and fed as individual sheets onto chute support 20 under upper cage 22 along a predetermined path into input opening 18.

Upper cage or guide 22 includes a perimeter framework 46 including a front end piece 48 and a rear end piece 50. Front end piece 48 is pivotally mounted to chute support 20 by bearings 52 so that upper cage 22 can be pivoted upwardly out of the way as necessary for press maintenance. Multiple rods 54 extend between end pieces 48 and 50 and carry adjustable guide wheel assemblies 56. The guide wheel assemblies include a clasp 58 for gripping rods 54 with and a lock washer and wing nut 62 for securing clasp 58 in a given position, and further include a wheel 64 oriented to rollingly direct stock 26 toward input opening 18 of press 14.

There are a variety of different feeding mechanisms including a myriad of different upper cage and stock holding/feeding mechanisms which can be used with printing presses. These devices include multiple parts made of steel such as illustrated by clasp 58, lock washer and wing nut 62, wheel 64, and roller bearings (not shown) located around the axle of wheel 64. Each of these parts can become loose over time or with wear and drop onto stock 26 being fed into press 14. Also, loose parts or tools such as Allen wrench 66 or screw 68 may inadvertently be left adjacent to or on chute support 20 where they can be knocked or vibrated onto chute support 20 and be carried into press 14.

Prior attempts to reduce the damage to presses have focused on preventative maintenance, education of employees, safety procedures and inspections before press start-up. Use of nonmetallic parts has generally been resisted since such parts are nonstandard and are generally less satisfactory in service. The safety device of the present invention not only allows use of standard steel parts, but is fully compatible with and can be adapted for use with most feeding apparatus.

Safety device 10 is preferably in the form of a magnetic bar 12 that extends across the width of input opening 18 to press 14. The magnetic bar 12 is about 1" in diameter and is as long as is needed to extend across input opening 18, though it is contemplated that bar 12 could be an electromagnet, or a series of multiple smaller permanent or electric magnets. Bar 12 is preferably spaced above chute support 20 about ½ depending upon the magnetic strength of bar 12 and the ability of bar 12 to pick up loose articles. It is preferred that the magnetic force of bar 12 is great enough to securely hold articles 58, 62, 64, 66 and 68 should these articles become loose and fall onto chute support 20 or onto stock 26 being fed into press 14. Also, it is advantageous if the inlet side of bar 12 includes an angled surface 31 (FIG. 4) so that the captured articles are picked up above the lowest point of bar 12 so that they are not later knocked off by successive of sheets 26 being fed into press 14. Further, the forward inclined surface 31 tends to wedge any larger loose articles such as an Allen wrench 66 against chute support 20, causing bunching of stock 26, and in turn causing the press to be stopped before the loose articles are fed damagingly into press 14.

Bar 12 is supported on either end by a support bracket 30. Support bracket 30 includes a base 32 attached to press 14, and a gripper 34 pivotally supported on base 32 by pivot pin 36. Gripper 34 includes an aperture 38 for receiving an end of bar 12. A set screw 42 protrudes into aperture 38 for engaging bar 12 to securely hold bar 12. Gripper 34 further includes a second set screw 44 that abuts base 32 permitting angular adjustment of gripper 34 on base 32 about pivot pin 36, thereby permitting adjustment of the distance of bar 12 above chute support 20. Optimally, distance "D" from bar 12 to chute support 20 is adjusted so that all loose articles can be securely picked up and held, but at a location at which bar 12 does not interfere with the feeding of stock 26 into press 14.

Thus, safety device 10 provides a magnetic bar 12 that magnetically catches and holds loose metal articles accidentally dropped or carried into the input opening of the printing press, holding same so that the loose metal articles can be later removed of and disposed of without causing damage to the press.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A safety device for a printing machine, the printing machine defining a path for sheet stock including an input opening for receiving the sheet stock and a working member located along the path behind the input opening for printing on the sheet stock, the working member including a surface that can be damaged by metal articles that come into contact with the working member, comprising:

metal articles that enter the input opening, said magnetic means being located at said input opening adjacent the path so that any metal articles entering the input opening are magnetically attracted to and held by said magnetic means and thus do not travel to the working member to damage same.

2. A device as defined in claim 1 wherein said magnetic means includes an elongate magnet extending across the input opening over the path used for feeding the sheet stock.

3. A device as defined in claim 2 including means for mounting said elongate magnet a distance above the path of the sheet stock, and further including means for adjusting said distance.

4. A device as defined in claim 3 wherein said elongate magnet includes a forward surface such that the metal articles attracted to said magnetic bar are picked up to a position whereat the metal articles will not be knocked loose from said magnetic bar into the printing machine after being magnetically attracted to said magnetic bar.

5. A device as defined in claim 1 wherein said magnetic means includes a permanent magnetic bar that is spaced a distance from the path of the sheet stock, and further including means for adjusting said distance.

6. A device as defined in claim 1 wherein said magnetic means includes a forward surface such that the metal articles attracted to said magnetic means are picked up to a position whereat the metal articles are not knocked off of said magnetic bar into the printing machine by subsequent stock fed into the printing machine.

7. A device as defined in claim 1 wherein said magnetic means includes a permanent magnet.

8. A device as defined in claim 1 wherein said magnetic means includes an electromagnet.

9. A press arrangement comprising:

a printing machine defining a path for sheet stock including an input opening for receiving the sheet stock and a working member located along the path behind the input opening for printing on the sheet stock, the working member including a surface that can be damaged by loose metal articles that come into contact with the working member;

a feeding apparatus connected to the printing machine for feeding sheet stock into said input opening, said feeding apparatus including metal articles that may come loose over time and be transported by sheet stock into contact with said working member; and magnetic means for magnetically attracting any loose metal articles that enter the input opening, said magnetic means being located at said input opening adjacent the path of the sheet stock so that any metal articles entering the input opening are magnetically attracted to and held by said magnetic means and thus do not travel to the working member to damage same.

10. A device as defined in claim 9 wherein said magnetic means includes an elongate magnet extending across the input opening over the path used for feeding the sheet stock.

11. A device as defined in claim 10 including means for mounting said elongate magnet a distance above the path of the sheet stock, and further including means for adjusting said distance.

12. A device as defined in claim 11 wherein said elongate magnet includes a forward surface such that the metal articles attracted to said magnetic bar are picked up to a position whereat the metal articles will not be knocked loose from said magnetic bar into the printing machine after being magnetically attracted to said magnetic bar.

13. A device as defined in claim 9 wherein said magnetic means includes a permanent magnetic bar that is spaced a distance from the path of the sheet stock, and further including means for adjusting said distance.

14. A device as defined in claim 9 wherein said magnetic means includes a forward surface such that the metal articles attracted to said magnetic means are picked up to a position whereat the metal articles are not knocked off of said magnetic bar into the printing machine by subsequent stock fed into the printing machine.

15. A device as defined in claim 9 wherein said magnetic means includes a permanent magnet.

16. A device as defined in claim 9 wherein said magnetic means includes an electromagnet.

17. A method for catching loose metal articles comprising:

providing a printing machine having internal parts defining a path for inputting stock, and a magnetic bar adapted to attach to the printing machine adjacent but spaced from the path; and magnetically attracting the loose metal articles before the metal articles enter the printing machine and damage an internal part therein.

* * * * *

UNITED STATES PATENT AND TRADEMARK OFFICE

CERTIFICATE OF CORRECTION

PATENT NO. : 5,170,712

DATED : December 15, 1992

INVENTOR(S) : William J. Stehouwer

It is certified that error appears in the above-identified patent and that said Letters Patent is hereby corrected as shown below:

Column 3, line 28;
"1/2" should be --1/4--.

Column 4, line 14;
After "comprising:" insert --magnetic means for magnetically attracting loose--.

Signed and Sealed this

Eighteenth Day of January, 1994

Bruce Lehman

*Attest:*

BRUCE LEHMAN

*Attesting Officer*

*Commissioner of Patents and Trademarks*